US006077053A

United States Patent [19]

Fujikawa et al.

[11] Patent Number: 6,077,053

[45] Date of Patent: Jun. 20, 2000

[54] PISTON TYPE GAS COMPRESSOR

[75] Inventors: Takao Fujikawa; Takahiro Yuki; Yoshihiko Sakashita; Yutaka Narukawa; Itaru Masuoka, all of Takasago, Japan

[73] Assignee: Kabushiki Kaisha Kobe Seiko Sho, Kobe, Japan

[21] Appl. No.: 09/058,185

[22] Filed: Apr. 10, 1998

[30] Foreign Application Priority Data

Apr. 10, 1997 [JP] Japan ..... 9-92488

[51] Int. Cl.[7] ..... F04B 17/00

[52] U.S. Cl. ..... 417/399; 417/403; 417/536; 417/568; 92/128

[58] Field of Search ..... 417/568, 536, 417/399, 403, 404; 92/128, 171.1

[56] References Cited

U.S. PATENT DOCUMENTS 4,169,433 10/1979 Crocker .
4,266,468 5/1981 Biggs ..... 92/63
4,334,833 6/1982 Gozzi ..... 417/258
4,380,322 1/1983 Budzich ..... 417/243

*Primary Examiner*—Henry C. Yuen
*Assistant Examiner*—Arnold Castro
*Attorney, Agent, or Firm*—Oblon, Spivak, McClelland, Maier & Neustadt, P.C.

[57] ABSTRACT

It is intended to provide a piston type gas compressor capable of replacing a seal ring of a piston with a new one while preventing incorporation of metallic particles into a processing gas. A gas suction port 9 and a gas discharge port 10 are formed in a flange 2 of a cylinder 3 in communication with a gas compressing space H. With a plug 7 removed from an internally threaded hole 6A, a free piston 5, together with a seal ring 4, can be inserted into and removed from the cylinder 3 through the internally threaded hole 6A.

8 Claims, 5 Drawing Sheets

PISTON TYPE GAS COMPRESSOR

BACKGROUND OF THE INVENTION

1. Field of the Invention

The present invention relates to a piston type gas compressor to be used for the supply, in an oil-free condition, such a gas as argon or nitrogen used in a hot isostatic pressing (HIP) apparatus or the like, which compressor uses a gas of several ten to 200 kgf/cm$^2$ as a gas source and generates a high-pressure gas of several hundred kgf/cm$^2$ or higher.

More particularly, the present invention is concerned with a piston type gas compressor wherein a seal ring used in a piston portion, which seal ring is of a high replacement frequency, can be replaced with a new one without removal of pipes, etc.

2. Description of the Prior Art

Reference is here made to Japanese Patent Publication No. 57233/90. In this patent publication there is disclosed "a compressor comprising a cylinder having a flange at one end thereof and a packing at the opposite end thereof, a cylinder head connected removably to the said flange, a piston rod extending at one end thereof into the cylinder through the packing, means for reciprocating the piston rod toward and away from the cylinder head, a free piston disposed within the cylinder and adapted to be engaged by the rod, a port for a pressure fluid which port is formed in the cylinder head, and means for introducing the fluid at a positive pressure into the cylinder through the port when the piston rod is spaced away from the cylinder head and for discharging the fluid as a high-pressure fluid from the cylinder through the port when the piston retreats toward the cylinder head." According to this prior art compressor: "By unscrewing the cylinder head, the piston can be removed easily, thus permitting replacement of the packing of the piston. When the packing of the piston is worn out to such a degree as requires replacement, it is not necessary to touch the tie rod which holds the components of the compressor in an assembled relation. All that is required is to remove common lines (pipes) from the cylinder head and remove the cylinder head."

Recently, studies have been made to utilize hot isostatic pressing in the manufacture of a very large scale integrated circuit, such as silicon wafer. It is to be noted that in the field of very large scale integrated circuits it has become necessary to take measures to cope with environments or conditions different from those so far applied to high-pressure equipment such as HIP apparatus.

Firstly, it is important to diminish particles up to the limit which particles are mixed into a processing gas in the interior of the apparatus halfway of the process. Particularly, the incorporation of transition metal particles causes a serious problem in the manufacture of a very large scale integrated circuit such as silicon wafer. In this connection, a compressor of such a structure as generates metallic worn particles poses a problem, and no consideration is given to a countermeasure in the foregoing conventional compressor.

Although the basic motion of the piston is a sliding motion, it is the portion of a piston packing that is in contact with the inner surface of the cylinder, so it is very likely that the piston will tilt from the axis of the cylinder. If the packing undergoes a local wear or tilts, the metallic portion of the piston comes into contact with the cylinder and generates metallic particles, which is not desirable.

Moreover, in process gas pipe lines in such an apparatus for the manufacture of a very large scale integrated circuit, particles are apt to be generated at pipe joint portions or valve portions. Particularly, there is a strong tendency to avoid such a structure as requires removal of pipe joint portions in maintenance, and a welded structure is usually adopted. According to the apparatus illustrated in the drawing of the foregoing prior art, repair of the piston packing requires removal of common lines (pipes) in the compressor. This is also a problem.

The apparatus for manufacturing a very large scale integrated circuit is usually operated 24 hours a day and for at least three weeks continuously. That is, a continuous operation of about 500 hours is usually performed. At every such three weeks, consumable portions are replaced as necessary. In a high-pressure operation of several hundred kgf/cm$^2$, the durability of the piston packing in the compressor is about 500 hours. That is, at every 500 hours it is required to make replacement with new one. Besides, several hours are required until restoration to the original state after the replacement. Therefore, it is desirable that the replacement work be done in as simple a manner as possible and that removable of pipes which would cause generation of particles be avoided.

In these points the foregoing conventional compressor involves a problem in its utilization in the field of manufacturing very large scale integrated circuits such as silicon wafers.

It is an object of the present invention to provide a piston type gas compressor which dispenses with removal of pipe connections to simplify the replacement work of replacing a piston seal portion in such a conventional piston type gas compressor as referred to above and decrease the amount of metallic particles generated unavoidably in such replacement work.

SUMMARY OF THE INVENTION

According to the present invention there is provided a piston type gas compressor comprising a cylinder 3 having a flange 2 at one end thereof, a free piston 5 fitted into the cylinder 3 axially movably through seal rings 4, a closure member 6 for closing an axial end of the cylinder 3, the closure member 6 being connected to the flange 2 in an overlapped relation to the flange and having an internally threaded hole 6A in a position opposed axially to the free piston 5, and a plug 7 threaded into the internally threaded hole 6A removably, wherein a gas compressing space H formed in the cylinder 3 is compressed with axial movement of the free piston 5. The following technical means are adopted for achieving the foregoing object of the invention.

The piston type gas compressor of the present invention is characterized in that a gas suction port 9 and a gas discharge port 10 are formed in the flange 2 so as to communicate with the gas compressing space H and that in a removed state of the plug 7 from the internally threaded hole 6A the free piston 5, together with the seal rings 4, can be inserted and removed through the internally threaded hole 6A. By adopting such a construction, even at the time of replacement of the seal rings 4 (seal members and packings) of the free piston 5, it is no longer required to remove pipes and hence it becomes possible to greatly decrease the amount of metallic particles which have so far been generated at every removal of pipes.

In the present invention, moreover, a tool engaging portion 11 for insertion and removal of the piston 5 is formed in an end face of the free piston 5 which end face is axially opposed to the plug 7, and the internally threaded hole 6A formed in the closure member 6 is larger than the outer diameter of the free piston 5 including the seal rings 4. By adopting such a construction, not only the foregoing function and effect are attained, but also the replacement work for the seal rings 4 can be done in a simple and quick manner, and the seal rings 4 can be prevented from being damaged when the free piston 5 equipped with new seal rings 4 is inserted into the cylinder 3.

Further, a cooling jacket 12 is disposed so as to surround the outer periphery of the cylinder 3. The cooling jacket 12 bears a load acting in the cylinder axis direction during gas compression. By adopting such a construction, it is possible to prevent the compression efficiency from being deteriorated by the heat generated during gas compression and prevent an excessive rise in temperature of the seal rings 4, etc., thus leading to prolongation of the service life and omission of any special component for bearing the axial load.

Drive means used in the present invention for making the free piston 5 movable axially is constituted by a reciprocating type hydraulic cylinder device 15, and on both sides of the axial ends of the hydraulic cylinder device 15 are disposed such piston type gas compressors 1 as described above. The hydraulic cylinder device 15 and the piston type gas compressors 1 are interlocked with each other so that by a reciprocating motion of the cylinder device 15 the gas present in the compressing space H of one gas compressor 1 is compressed and discharged through the discharge port 10 and at the same time the gas is introduced through the suction port 9 into the compressing space H of the other gas compressor 1. By adopting such a construction, the gas compressing work efficiency can be improved.

DETAILED DESCRIPTION OF PREFERRED EMBODIMENTS

Preferred embodiments of the present invention will be described in detail hereinunder with reference to the accompanying drawings.

Figure 1:
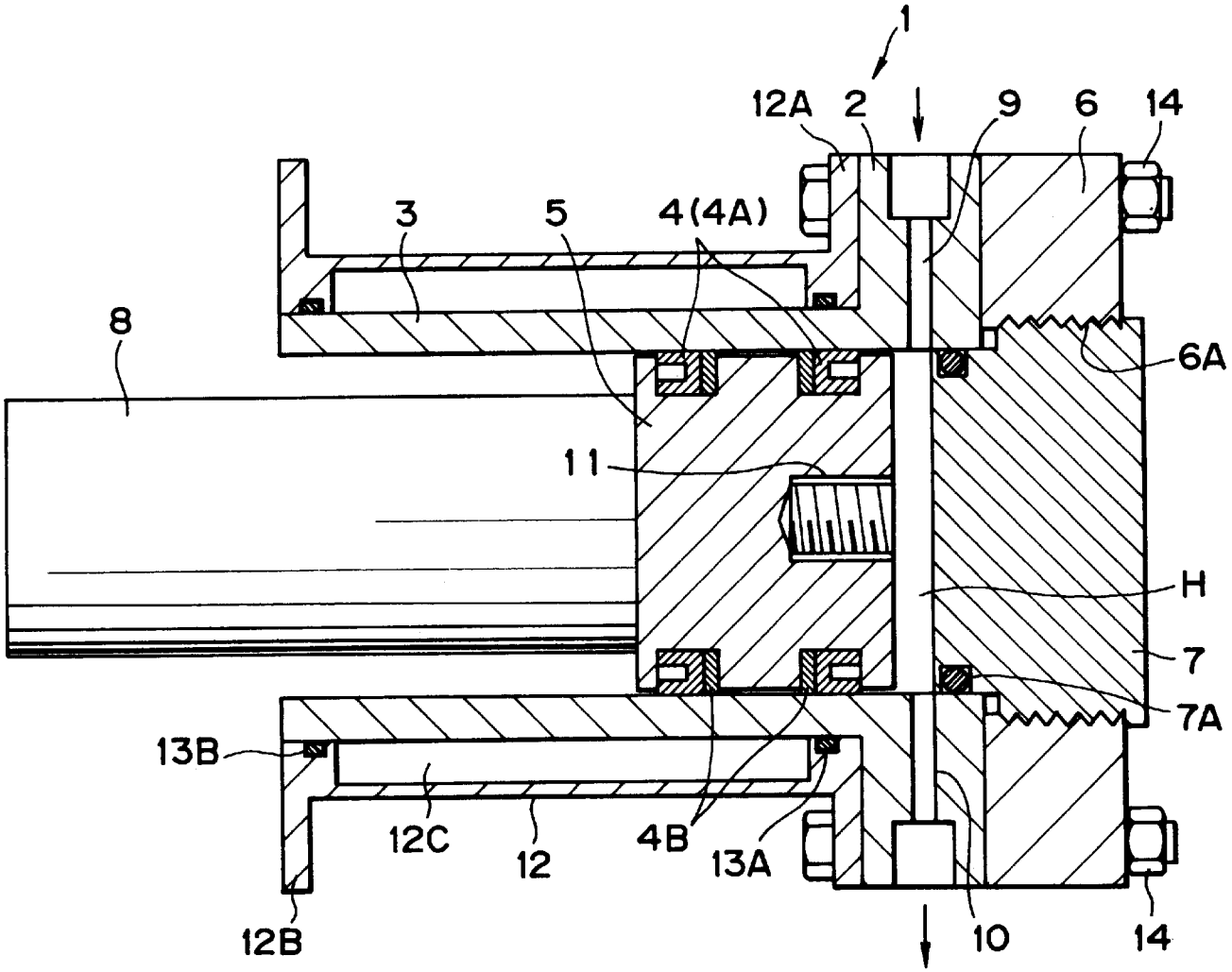
FIG. 1 is a sectional view schematically showing a piston type gas compressor according to the present invention.

FIG. 1 illustrates schematically the construction of a piston type gas compressor 1 according to the present invention.

In FIG. 1, the compressor 1 comprises a cylinder 3 having a flange 2 at one end thereof, a free piston 5 fitted into the cylinder 3 axially movably through seal rings (seal members) 4, a closure member 6 for closing an axial end of the cylinder 3, the closure member 6 being connected to the flange 2 in a superimposed relation to the flange and having an internally threaded hole 6A in a position axially opposed to the free piston 5, a plug 7 threaded removably into the internally threaded hole 6A and sealed with an O-ring 7A, and a rod 8 engaged with the piston 5 to drive the piston 5. A gas compressing space H formed within the cylinder 3 is compressed with an axial movement of the free piston 5.

Further, in the flange 2 there are formed a gas suction port 9 and a discharge port 10 each independently in communication with the gas compressing space H. With the plug 7 removed from the internally threaded hole 6A, the seal ring 4, together with the free piston 5, can be inserted and removed through the hole 6A.

To be more specific, a tool engaging portion 11 for insertion and removal of the piston 5 is formed in an end face of the free piston 5 which end face is axially opposed to the plug 7. In the figure, the tool engaging portion 11 is illustrated as an internally threaded hole. The internally threaded hole 6A formed in the closure member 6 is larger than the outer diameter of the free piston 5 including seal rings 4.

As to the seal rings (seal members) 4 of the free piston 5 used in the above construction, there may be used only one such seal ring. The construction of FIG. 1 is preferred in which two seal rings are provided respectively on a high-pressure gas side and an atmospheric pressure side in an axially spaced relation to each other so that even upon tilting of the free piston 5 from the axis of the cylinder and the resulting contact of a piston edge portion with the inner surface of the cylinder 3 there are not generated metallic worn particles.

In this case, as shown in FIG. 1, U-shaped packings 4A are disposed in such a manner that the concave portion of each such packing is located on a high pressure side, and then back-up rings 4B are mounted. For example, U-shaped packings are positioned on the high-pressure gas side, while O-rings are disposed on the atmospheric pressure side, or on the high-pressure gas side there may be used what is called a Bridgeman type seal member whose pressure receiving area has been adjusted so that the pressure of the seal ring portion becomes higher than the pressure of gas under the action of the gas pressure. Thus, an appropriate selection may be made in accordance with the discharge pressure, etc.

If it is necessary to evacuate and degas the interior of the gas compressing space in the compressor, the use of an O-ring on the atmospheric pressure side permits a more ensured vacuum seal than in the use of only U-shaped packing or Bridgeman type seal.

As to the material of each seal member 4, a resin is selected from among, for example, urethane, Teflon and nylon in the case of U-shaped packing or Bridgeman type seal, while in the case of O-ring, a rubber material is selected from among, for example, nitrile rubber, fluorine-contained rubber and silicone rubber. For example, this selection is made on the basis of friction coefficient, wear resistance and heat resistance. A material small in friction coefficient and superior in both wear resistance and heat resistance is preferred from the standpoint of service life.

Even if the sealing material is optimized as above, if the discharge pressure is as high as several hundred $kgf/cm^2$ or more in such a piston type gas compressor 1, the life of the piston seal portion is fairly short. This is known experientially. At a discharge pressure of 500 $kgf/cm^2$ or more, the service life expires in 2000 hours or so. Consequently, it becomes necessary to perform a replacement work. In the case of a continuous 2000 hour operation, replacement is required in 80 days or a little longer, namely, in a period shorter than three months. In view of this point it is necessary that the replacement work for the seal member 4 be as simple as possible. For satisfying this requirement, it is important to make a design so as to decrease the number of components to be removed in the replacement work.

According to the present invention, the work for removing the free piston 5 from the cylinder 3 can be done by merely pulling out the plug 7 threaded into the internally threaded hole 6A of the closure member 6 and threaded engagement and subsequent removal of a tool such as, for example, a long bolt with and from the tool engaging portion 11 shown previously as a "bolt hole for piston extraction" and formed centrally of an end face of the free piston 5. It is not necessary at all to remove pipes, etc. connected to the suction port 9 and discharge port 10.

On the other hand, the work for removing the seal members 4 such as packings from the free piston 5 which has thus been taken out into the atmosphere and replacing them with new ones is conducted in the conventional manner. Also as to the work for restoration to the original state, it can be done by only reversing the above piston taking-out work. Thus, all of the operations required are very simple. Such an advantage of the present invention that the replacement of the piston seal members 4 can be done even without removal of pipes is outstanding particularly when the invention is applied to a pressure filling process for a silicon semiconductor substrate or the like in which process the incorporation of metallic particles influences the product quality.

In more particular terms, pipe connections are formed using pipe joints of metal-to-metal contact, so in such a high pressure condition as that being considered, metallic particles are generated more or less at each of such contact portions because contact surfaces are pushed strongly against each other for connection, which particles flow into the processing chamber together with the flow of gas. As the number of portions to be removed increases, the chance of incorporation of such metallic particles increases and the chance of incorporation of contaminants from the atmosphere also increases. According to the present invention, the process gas contact portions exposed to the atmosphere during replacement of the piston seal members are kept to a minimum, which are only the piston portion and the inner surface of the cylinder as a high-pressure cylinder. Thus, it becomes possible to diminish the chance of incorporation of such metallic particles.

Reference is now made to FIG. 1. In a surrounding relation to the outer periphery of the cylinder 3 is disposed a cylindrical cooling jacket 12 through O-rings 13A and 13B located at both axial ends of the jacket. The jacket 12 has flanges 12A and 12B formed at both axial ends thereof. One flange 12A is fixed together with the flange 2 of the cylinder 3 and the closure member 6, using bolt-nut clamp means, while the other flange 12B is secured to a fixing member (not shown), to bear a load acting in the cylinder axis direction during gas compression. Further, a refrigerant (cooling water) is allowed to pass through a passage 12C formed by both outer peripheral surface of the cylinder 3 and inner peripheral surface of the cooling jacket 12, thereby preventing a lowering of compression efficiency due to heat generated by the compression of process gas such as argon gas or nitrogen gas and also preventing an excessive rise in temperature of the seal members, etc.

According to the construction illustrated in FIG. 1, the closure member 6 and a drive portion (a stationary member) are combined together by the cooling jacket 12 and in this state an axial load developed by the pressure of the high-pressure gas in the gas compressing space H is borne by the cooling jacket. As an alternative method, the closure member 6 and the drive portion may be combined together using a plurality of rod members (tie rods) to bear the axial load. Provided, however, that by bearing the axial load with use of the cooling jacket 12 as illustrated in the figure it is made possible to decrease the number of components.

Figure 2:
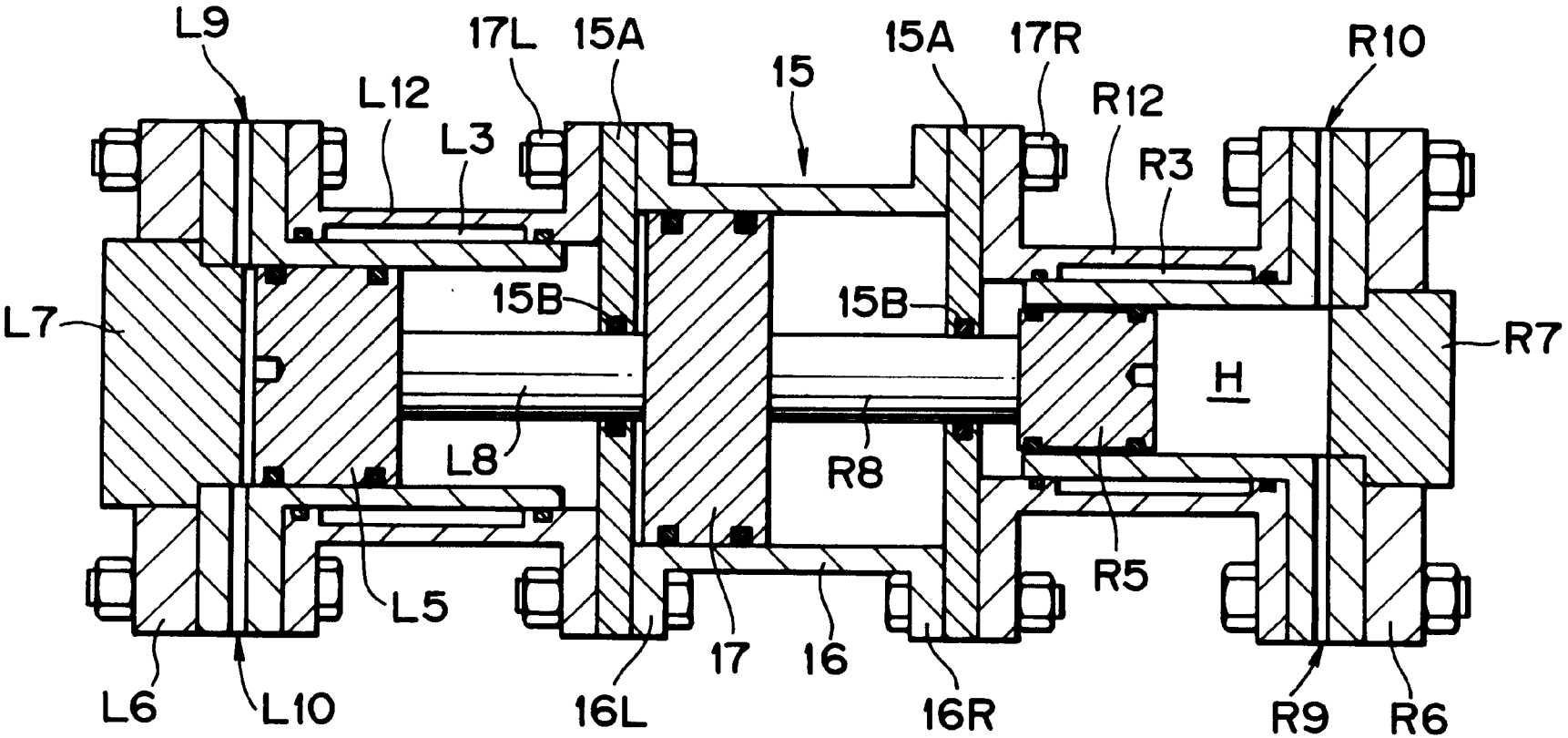
FIG. 2 is a sectional view schematically showing a gas compressing equipment according to the present invention which equipment is equipped with two piston type gas compressors.
Figure 3:
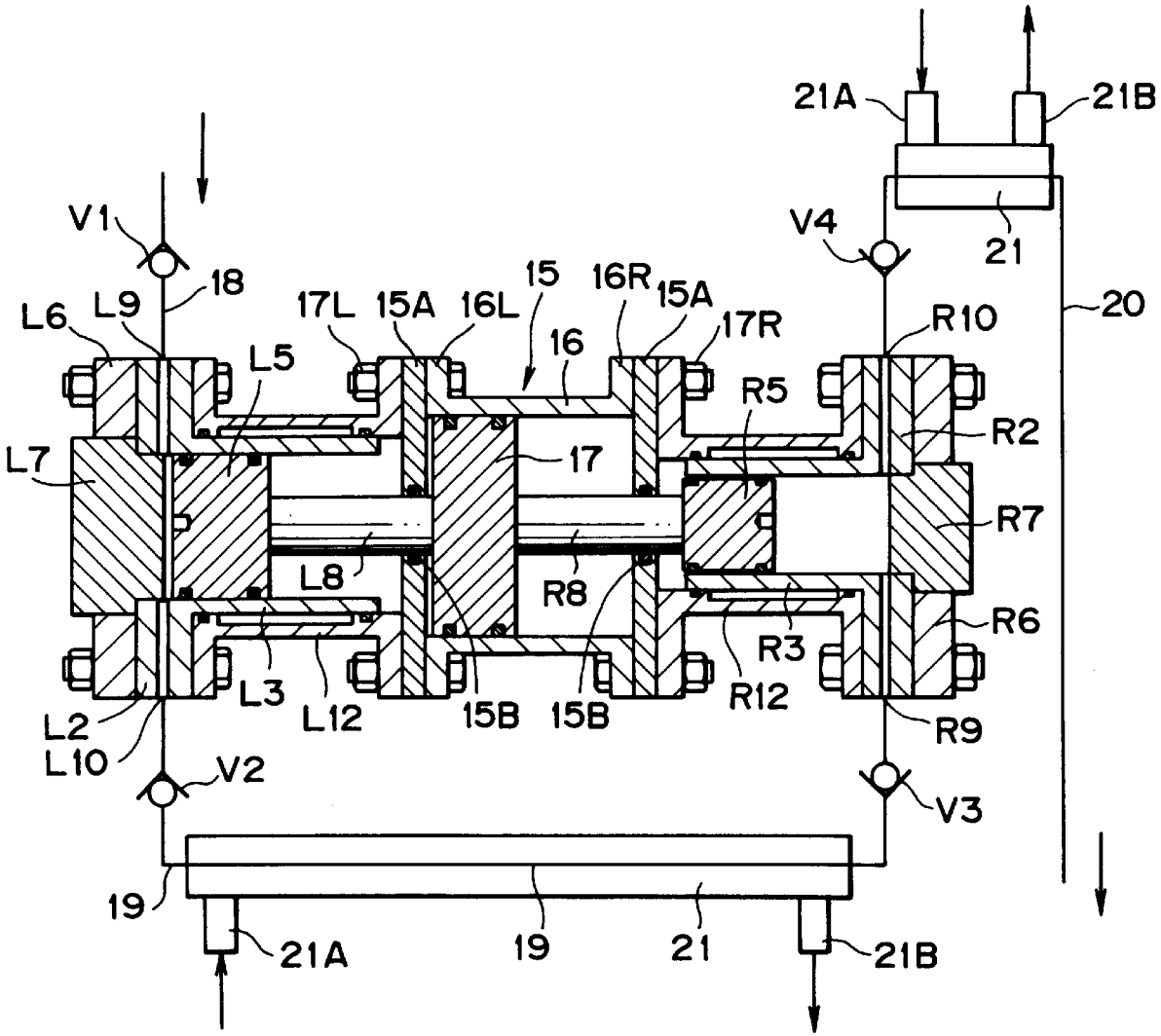
FIG. 3 is an entire construction diagram.

Referring now to FIGS. 2 and 3, there is schematically illustrated a gas compressing equipment using two such piston type gas compressors 1 as described above in connection with FIG. 1.

In this gas compressing equipment, the drive means for moving the free piston 5 axially is a reciprocating type hydraulic cylinder device 15. On both sides of axial ends of the hydraulic cylinder device 15 are disposed piston type gas compressors 1. The hydraulic cylinder device 15 and the gas compressors 1 are interlocked with each other so that with a reciprocating motion of the cylinder device the gas present in the compressing space H of one gas compressor 1 is compressed and discharged from the discharge port 10 and at the same time the gas is introduced through the suction port 9 into the compressing space H of the other gas compressor 1.

In FIGS. 2 and 3, the piston type gas compressors disposed on both sides of axial ends of the hydraulic cylinder device 15 are of the same construction as that described previously in connection with FIG. 1, so the members and portions common to both are identified by common reference numerals, and as to the left-hand (first-stage) gas compressor, reference numerals are preceded by the mark L, while as to the right-hand (second-stage) gas compressor, reference numerals are preceded by the mark R, for convenience' sake.

The hydraulic cylinder device 15 comprises a cylinder 16 having flanges 16L and 16R at both ends thereof, and a hydraulic piston 17 fitted for reciprocating motion into the cylinder 16. Cylinder covers 15A, 15A are held grippingly by the flanges 16L, 16R and flanges of cooling jackets L12, R12, and all of them are combined together using bolt-nut clamp means 17L and 17R. Driving rods (piston rods) L8 and R8 are respectively fitted in the inner peripheries of the left and right cylinder covers 15A, 15A slidably in an oil-tight manner through seal members (O-rings) 15B. End faces of the driving rods L8 and R8 are in abutment with left and right free pistons L5, R5, respectively.

In the illustrated embodiment, the cylinder and free piston in the second-stage gas compressor R1 are smaller in sectional area than the cylinder and free piston in the first-stage gas compressor L1, to generate a higher pressure. In the first-stage gas compressor, a first pipe 18 for introducing gas, which pipe has a first check valve V1, is connected to a suction port L9, and a second pipe 19 having a second check valve V2 is connected to a discharge port L10. The second pipe 19 is also connected through a third check valve V3 to a suction port R9 in the second-stage gas compressor. In the second-stage gas compressor, a third pipe 20 having a fourth check valve V4 is connected to a discharge port R10. The third pipe 20 is also connected to a process chamber (a chamber for carrying out a pressure filling process for a silicon semiconductor substrate or the like).

With leftward movement of the hydraulic piston 17, the gas introduced through the suction port L9 into a first-stage cylinder L3 is compressed and discharged from the discharge port L10 and at the same time the gas is introduced through the suction port R9 in a second-stage cylinder R3. Next, with rightward movement of the hydraulic piston 17, the gas present in the second-stage cylinder R3 is discharged from the second-stage discharge port R10. The gas pressure is increased in accordance with the sectional area of each stage of piston and the load developed by the driving oil pressure, so such sizes and load are set to appropriate values according to the value of pressure to be finally obtained. For carrying out the above operations, it is desirable that the first to fourth check valves V1–V4 be electromagnetic type valves whose on and off are remotely controlled As shown in FIG. 3, the rise in gas temperature due to heat generated during gas compression deteriorates the compression efficiency and therefore it is desirable that the second and third pipes 19, 20 through which the gas discharged from each stage of discharge port passes be inserted into a cooler 21 into which cooling water flows through inlet and outlet 21A, 21B, to eliminate heat from the compressed gas.

In FIG. 1, the member for fixing the flange 12B of the cooling jacket 12 corresponds to the flange 16R of the hydraulic cylinder 16 or to the associated cylinder cover 15A.

Figure 4:
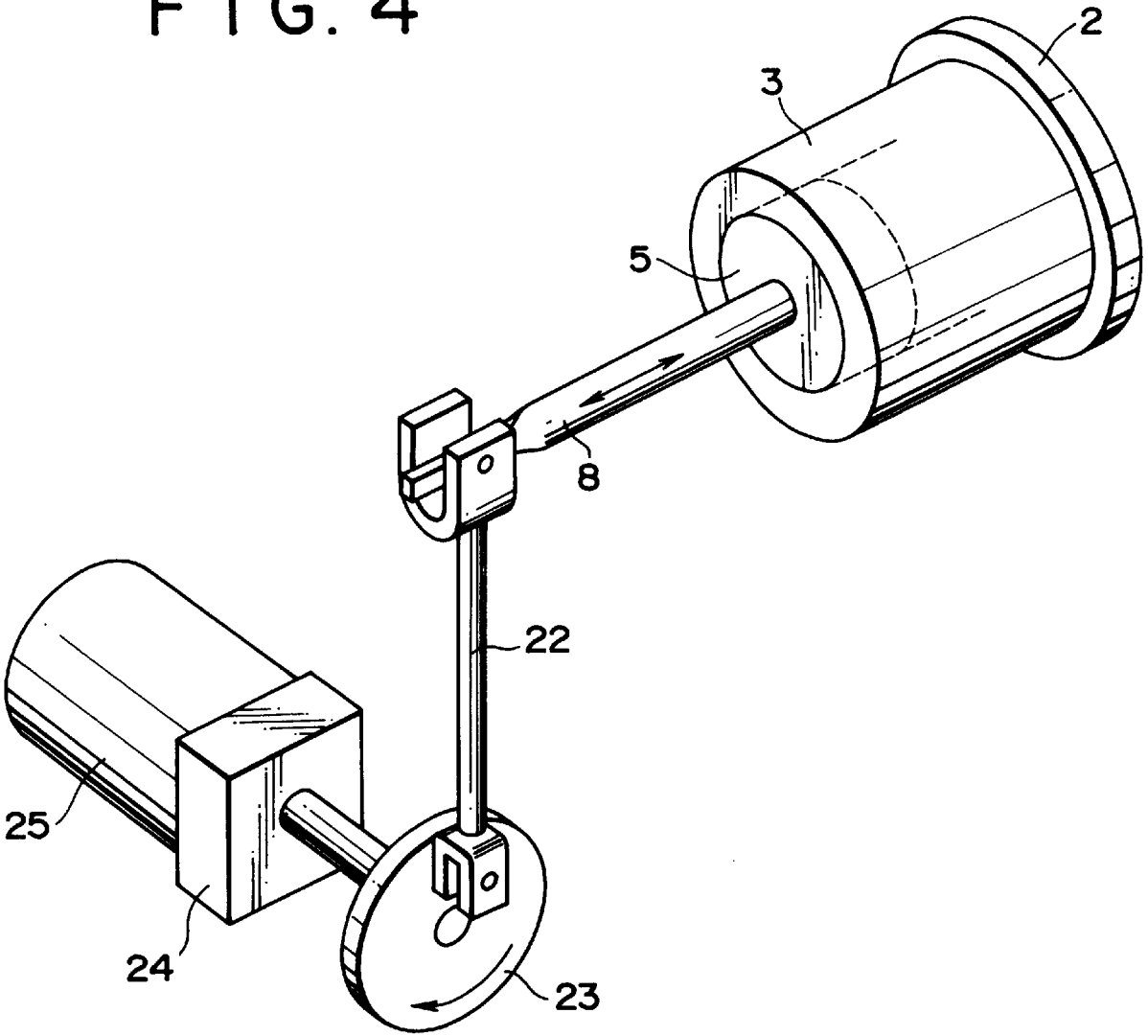
FIG. 4 is a schematic diagram showing a first example of a mechanical drive means.
Figure 5:
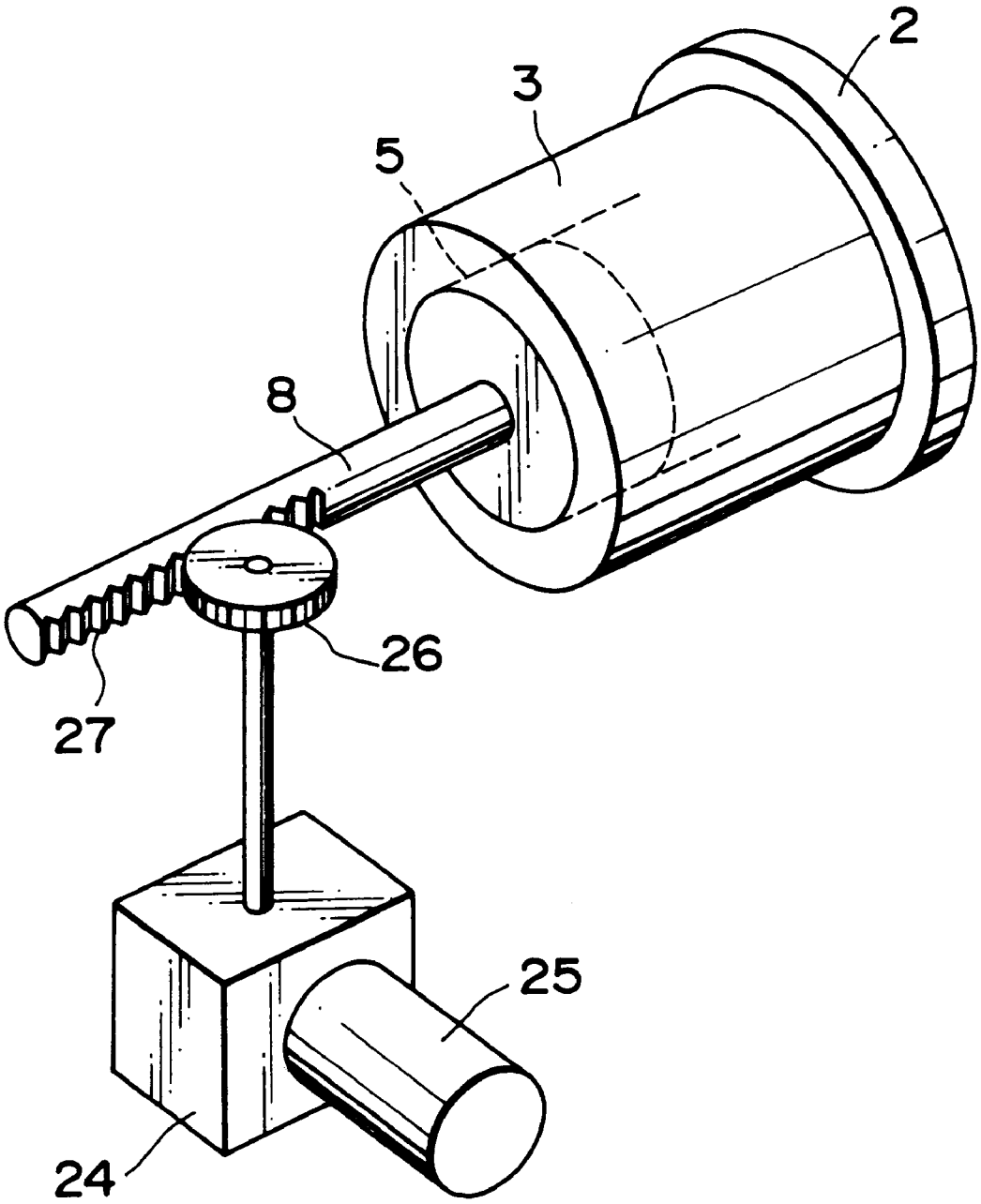
FIG. 5 is a schematic diagram showing a second example of a mechanical drive means.

FIGS. 4 and 5 show examples in which an electric motor, not an oil pressure, is used as a power source and the rotation thereof is converted mechanically into a reciprocating motion to reciprocate the driving rod 8.

In FIG. 4, one end of a connecting rod 22 is pivotally connected to the driving rod 8, while the opposite end thereof is pivotally connected to an eccentric pin of a crank member 23, which crank member is driven by an electric motor 25 equipped with a reduction mechanism 24. In this example, the driving rod 8 somewhat moves vertically while it slides, so it is desirable for the driving rod 8 to abut the free piston 5 through a spherical seating face.

In FIG. 5, a pinion 26 is rotated forward and reverse by means of an electric motor 25 equipped with a reduction mechanism 24 and capable rotating forward and reverse, with the pinion 26 being brought into mesh with rack 27 of a driving rod 8.

The free piston driving means illustrated in FIGS. 4 and 5 are effective when the use of oil pressure is unsuitable in relation to peripheral equipment for example.

According to the present invention, as set forth hereinabove, the replacement of the piston seal members in the piston type compressor can be done in a simple manner. Particularly, since the seal member replacement can be done without removal of pipes, it is possible to greatly decrease the amount of metallic particles generated at every removal of pipes which is a problem involved in the prior art. As a result, the processing for silicon semiconductor using a high-pressure gas can be done on an industrial scale. Thus, the present invention greatly contributes to the development of this industrial field.

What is claimed is:

1. A gas compressor comprising:

a cylinder;

a free piston fitted into said cylinder through a seal ring so as to be movable axially, with a gas compressing space formed within said cylinder being compressed by an axial movement of said free piston;

a flange formed at one end of said cylinder;

a closure member connected to said flange in a superimposed relation thereto to close an axial end portion of said cylinder;

an internally threaded hole formed in said closure member in a position axially opposed to said free piston;

a cooling jacket formed in a surrounding relation to the outer periphery of said cylinder, said cooling jacket being mounted to bear a load acting on the closure member in the cylinder axis direction during gas compression;

a plug threaded into said internally threaded hole removably; and a gas suction port and a gas discharge port both formed in said flange so as to communicate with said gas compressing space, wherein with said plug removed from said internally threaded hole, said free piston, together with said seal ring, can be inserted into and removed from said cylinder through the internally threaded hole.

2. A gas compressor according to claim 1, wherein said internally threaded hole formed in said closure member is larger than the outer diameter of said free piston including said seal ring.

3. A gas compressor according to claim 1, wherein a tool engaging portion for insertion and removal of said free piston is formed in an end face of the free piston which end face is axially opposed to said plug.

4. A gas compressing equipment comprising two said gas compressors of claim 1 and a reciprocating type cylinder device as drive means for moving said free piston axially, one of the gas compressors being disposed as a first-stage gas compressor on one axial end side of said cylinder device and the other gas compressor disposed as a second-stage gas compressor on an opposite axial end side of the cylinder device, said gas compressors and said cylinder device being interlocked with each other so that the gas present within said gas compressing space in one gas compressor is compressed and discharged from the discharge port and at the same time the gas is introduced into the gas compressing space in the other gas compressor.

5. A gas compressing equipment according to claim 4, wherein said cylinder device is driven using an oil pressure.

6. A gas compressing equipment according to claim 4, wherein the gas discharged from one gas compressor is conducted into the suction port of the other gas compressor.

7. A gas compressing equipment according to claim 6, wherein the sectional area of the cylinder in the second-stage gas compressor is smaller than that of the cylinder in the first-stage gas compressor.

8. A gas compressor according to claim 1, wherein said free piston is driven by an electric motor.

* * * * *